United States Patent [19]

Maloney

[11] 4,065,325

[45] Dec. 27, 1977

[54] ADAPTABLE FLUSH ATTACHMENT FOR MARINE ENGINES HAVING SIDE COOLING WATER PORTS

[76] Inventor: John Vincent Maloney, 1985 Illinois Ave. NE., St. Petersburg, Fla. 33703

[21] Appl. No.: 658,761

[22] Filed: Mar. 25, 1976

[51] Int. Cl.[2] ..... B08B 3/02; B08B 9/00

[52] U.S. Cl. ..... 134/167 R; 115/75; 134/169 A; 134/199

[58] Field of Search ..... 115/75, 17; 134/166 R, 134/167 R, 168 R, 169 R, 169 A, 172, 199

[56] References Cited

U.S. PATENT DOCUMENTS

| | | | |
|---|---|---|---|
| 2,611,631 | 9/1952 | Benson | 134/167 R |
| 2,644,474 | 7/1953 | Houchin | 134/166 R |
| 3,002,488 | 10/1961 | Guhlin | 115/17 |
| 3,003,456 | 10/1961 | Crozier | 115/17 |
| 3,886,889 | 6/1975 | Burger | 115/17 |
| 3,931,828 | 1/1976 | Lawler | 134/167 R |

*Primary Examiner*—Trygve M. Blix
*Assistant Examiner*—Stuart M. Goldstein

[57] ABSTRACT

This application discloses a device universally adaptable for use in flushing outboard and inboard/outboard marine engines; this being possible due to the unique design of the strap and the shape of the cups allowing for the device to attach flush against the motor shaft housing on motors having shaft housings of different dimensions and contours, something not accomplished by any previously known means.

6 Claims, 8 Drawing Figures

ADAPTABLE FLUSH ATTACHMENT FOR MARINE ENGINES HAVING SIDE COOLING WATER PORTS

BRIEF SUMMARY OF THE INVENTION

A device which provides an attachment by which a hose can be connected to a marine engine, after removing it from the water, for the purpose of flushing it with fresh water. The object being one fast, easy to use attachment which is quickly assembled or changed to adapt to different sizes and makes of outboard or inboard/outboard marine engines since the water cooling parts vary in size and location on engines.

DETAILED DESCRIPTION OF DRAWINGS

The strap and both molded parts are uniquely designed and manufactured for use as described in this application. The device is comprised of a strap, two cup shaped molded parts, a screw and a wingnut. The strap has a clamping device which allows the strap to be adjusted lengthwise and includes a prepunched hole. The prepunched hole accepts the button shaped to of one of the cup parts and holds it in place.

Figure 1:
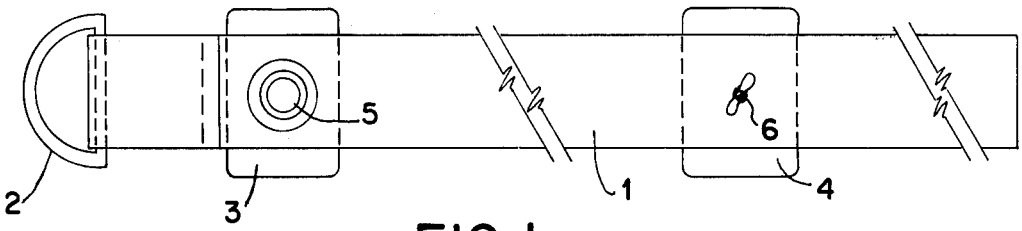
FIG. 1 shows a view of the assembly of the device.

Referring to FIG. 1 the parts of the device can be seen in plane view in assembled position. The strap 1, has a prepunched hole and a clamping device 2, which allows the strap to be adjusted lengthwise and held tightly after the other end of the strap is engaged in the clamping device 2. The molded parts 3 and 4 are attached to the strap 1. Both molded parts 3 and 4 are rectangular cup shapes and the first of these 3 has a flared shaped top which fits through the prepunched hole in the strap 1, the top of this flared top being larger than the hole in the strap 1, thereby keeping it from disengaging from the strap 1. Inside this shaped top is a hole 5 which allows the male fitting of an ordinary garden hose to be friction fit. The second of the molded parts 4 does not have a flared top, but is otherwise similar to 3 and it is attached to the strap 1 by means of a screw and a nut 6. The distance between 3 and 4 on the strap is completely adjustable since 4 can be attached at any location along the strap 1.

Figure 2:
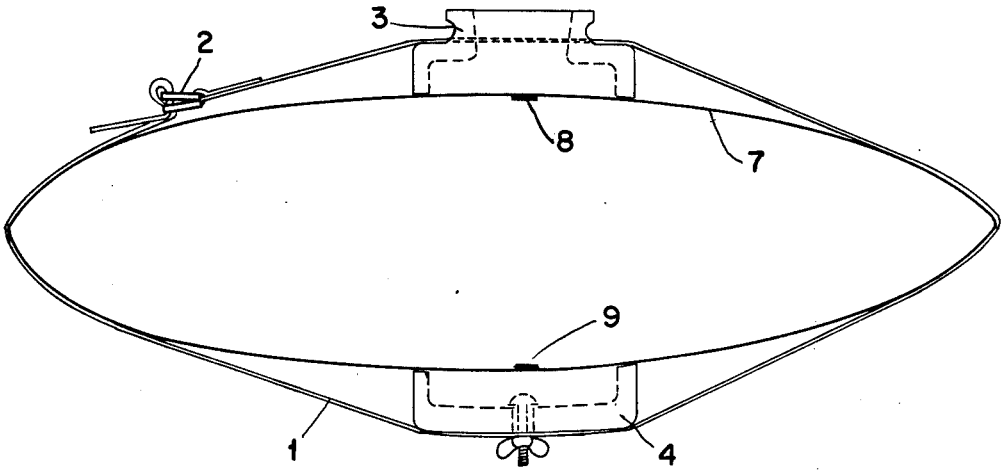
FIG. 2 shows a view of the device attached to the section of the outboard motor shaft.
Figure 4A:
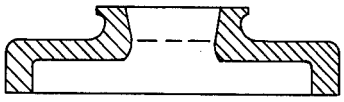
FIGS. 4A and 5A show a section view of FIGS. 4 and 5 respectively.
Figure 5A:
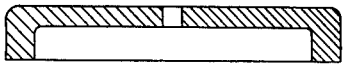
Figure 4:
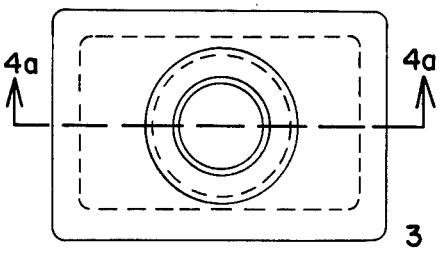
FIGS. 3 and 4 and 5 show the individual parts in plane view.
Figure 5:
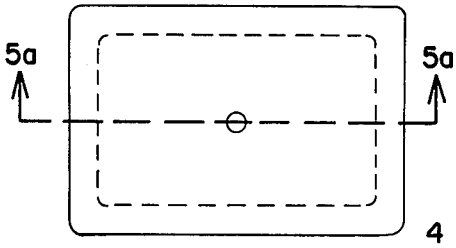
Figure 3A:
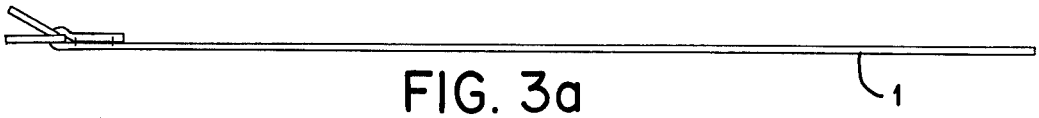
FIG. 3*a* is an elevation view of the strap shown in FIG. 3.
Figure 3:
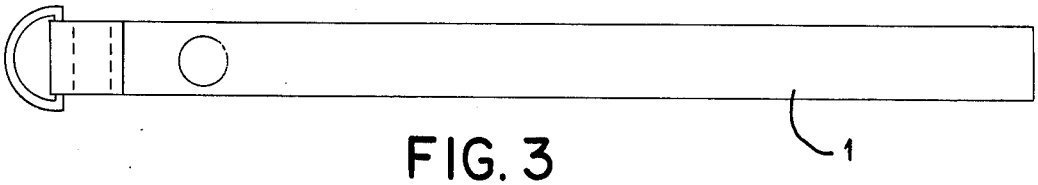

In FIG. 2 the device can be seen attached to a motor shaft housing 7. The free end of the strap is held by the clamping device 2, so that the rectangular cup shaped part 3 covers and is held tightly over the water inlet port 8 on one side of the motor shaft housing. The other cup shaped device 4 having been attached to the strap at the location required to cover the water inlet ports 9 on the opposite side of the housing now cover these ports 9 and is tightly held against the housing. Both rectangular cups 3 and 4 can be rotated around their strap attachments to best fit tightly the contour of the motor shaft housing 7 and cover the cooling water inlet ports 8 and 9.

This device provides an advantage over other methods of flushing this type marine engine in that it is faster to attach to the engine and is the only such device adaptable for use on all sizes and makes of marine outboard and inboard/ outboard engines with side cooling water ports.

I claim:

1. A fresh water flushing device for small boat marine engines having side cooling water ports in the drive unit housing, consisting of a flexible strap, a flexibly resilient non-metallic generally rectangular cup shaped device having an aperture in the bottom center of such an internal diameter to tightly engage a common garden hose male fitting, the rim of the cup shaped device being substantially rigid and extending outwardly from the housing at substantially right angles to the cooling water ports and being of such size as to surround the cooling water inlet ports on one side of the unit, this cup shaped device being attached in a lengthwise fixed position on the strap, a second generally rectangular cup shaped device similar in size and material to the first cup adjustably fixed to the strap at a lengthwise location thereon as to cover the cooling water ports on the opposite side of the unit, the strap extending beyond both cup shaped devices and of a length to be wrapped around the motor shaft drive unit with a quick detachable fastener at the end of the strap to perform the function of attaching the ends of the strap at whatever length required to hold the device in place on the motor shaft drive unit thereby providing a flushing attachment adaptable to all types and sizes of outboard and inboard/outboard marine engines with side cooling water ports.

2. A fresh water flushing device for adaptably attaching to a variety of makes and models of small boat marine engines having side cooling water ports in the drive unit housing the device consisting of a strap, a substantially rectangular cup shaped device attached to the strap and having a through aperture of such diameter to tightly engage a common garden hose fitting, the outer edges of the device being substantially rigid and extending outwardly from the housing at substantially right angles to the cooling water ports and being of such size as to surround the cooling water inlet ports on one side of the unit, a second such rectangular cup shaped device attached to the strap at whatever location necessary to cover the cooling water inlet ports on the opposite side of the unit, the strap to extend beyond the attached devices and to be of such length as to wrap around the motor shaft drive unit with a quick detachable fastener at the ends of the strap to attach the ends at whatever length required to hold the device in place on the motor shaft drive unit thereby providing a flushingattachment adaptable to all types and sizes of outboard and inboard/outboard marine engines having side cooling water ports.

3. The invention according to claim 2 wherein the cup shaped devices are axially turnable on the strap.

4. The invention according to claim 2 wherein the cup shaped devices are of substantially uniform thick cross-section to provide strength to resist deflection by internal water pressure.

5. The invention according to claim 4 wherein the cup shaped devices are axially turnable on the strap.

6. The invention according to claim 2 wherein the strap quick detachable fastener is infinitely adjustable.

* * * * *